US006260708B1

(12) United States Patent
Adam et al.

(10) Patent No.: US 6,260,708 B1
(45) Date of Patent: Jul. 17, 2001

(54) METHOD FOR AIR CLASSIFICATION OF TONER

(75) Inventors: Marcus Adam, Stadtbergen; Stefano Zampini, Augsburg; Bodo Furc Hner, Kissing, all of (DE)

(73) Assignee: Hosokawa Alpine Aktiengesellschaft, Ausburg (DE)

( * ) Notice: Subject to any disclaimer, the term of this patent is extended or adjusted under 35 U.S.C. 154(b) by 0 days.

(21) Appl. No.: 09/233,059

(22) Filed: Jan. 20, 1999

Related U.S. Application Data

(63) Continuation-in-part of application No. 08/953,721, filed on Oct. 17, 1997, now Pat. No. 6,109,448.

(30) Foreign Application Priority Data

| | | |
|---|---|---|
| Oct. 18, 1996 | (DE) | 196 43 023 |
| Oct. 18, 1996 | (DE) | 196 43 068 |
| Oct. 18, 1996 | (DE) | 196 43 042 |
| Oct. 18, 1996 | (DE) | 196 43 043 |
| Jan. 28, 1998 | (DE) | 198 03 107 |

(51) Int. Cl.[7] ..... B07B 4/00

(52) U.S. Cl. ..... 209/139.2; 209/132; 209/133; 209/134; 209/138; 209/142

(58) Field of Search ..... 209/456, 466, 209/132, 133, 134, 138, 139.2, 142, 143, 713, 20, 21, 148; 241/79.1

(56) References Cited

U.S. PATENT DOCUMENTS

| | | | |
|---|---|---|---|
| 4,304,360 | 12/1981 | Luhr et al. | 241/5 |
| 5,115,989 * | 5/1992 | Poeschl | 241/79.1 |

FOREIGN PATENT DOCUMENTS

| | | |
|---|---|---|
| 39 15 641 | 11/1990 | (DE) . |
| 40 14 342 | 11/1991 | (DE) . |

* cited by examiner

*Primary Examiner*—Donald P. Walsh
*Assistant Examiner*—Mark J. Martin
(74) *Attorney, Agent, or Firm*—Winston & Strawn

(57) ABSTRACT

The method for air classification of toner used to develop electrostatic images, whereby a toner product consisting of a powder with a wide particle size distribution is converted into a higher-quality toner product with a narrow particle size distribution in that the residence time of the toner product is controlled by means of components, components which in the upper section of the classifying chamber quickly introduce the toner product in a homogeneous state into the classifying chamber, which in the central section of the classifying chamber permit a longer residence time of the toner product, and which in the bottom section of the classifying chamber permit rapid discharge of the toner product from the classifying chamber, all of which makes it possible to produce a toner end product with an extremely narrow particle size distribution.

25 Claims, 7 Drawing Sheets

METHOD FOR AIR CLASSIFICATION OF TONER

This application is a continuation in part of application Ser. No. 08/953,721, filed Oct. 17, 1997 now U.S. Pat. No. 6,109,448.

FIELD OF THE INVENTION

The invention described here concerns a manufacturing process for toner of a defined particle size distribution to permit electrostatically generated images to be developed, and especially concerns a classifying process to permit adjustment of the required particle size distribution as a means of achieving an ultrahigh-quality toner.

BACKGROUND OF THE INVENTION

The state-of-the-art method of manufacturing toner includes a number of processes such as the mixing of suitable components, extrusion, cooling, and downstream comminution. The comminuted material is then routed to a downstream classifying process with the aim of removing the undesirable particle fractions and of producing an end product of the desired particle size distribution. The particle size distribution (PSD) is usually measured with a Coulter Counter Multisizer made by Coulter Electronics, Inc., USA. The objective of the classifying process is generally the separation of extremely fine particles in the range under 5 $\mu$m, but is sometimes also achievement of an upper particle limit or of both objectives together.

For this purpose, conventional processes use classifiers as are known from German patent DE 39 15 641 A1. With such classifiers, in which there is no controlled product feed, the classified product can backmix with the feed product. This leads to the product becoming contaminated by undesirable fines, which adversely affects the success of the classifying process. Furthermore, the dispersion of the feed material directly upstream of the classifying chamber in these classifiers is inadequate, meaning that agglomerates can form and thus transport particles which are actually too fine into the coarse material. This type of contamination, where fine particles contaminate the end product, can lead to a loss of quality when using the toner for printed images.

SUMMARY OF THE INVENTION

The core objective of this invention is to devise a toner manufacturing process which solves the above-described problems and makes it possible to produce a toner powder with the required narrow particle size distribution in the most effective way. Another objective is to devise a process which makes it possible to reduce the fines portion in the end product. Over and above this, the objective concerns a process which is not only capable of reducing the fines portion, but also of limiting the top size, by which means a narrow particle size distribution through classifying with a controlled material feed is achieved, whereby the feed material is obtained by means of mixing, extruding and comminuting a base mixture.

The objectives of the invention are solved in that a centrifugal plate achieves a uniform distribution of the toner product across the extent of the classifying wheel, the toner product is routed by means of a controlled material feed section in gravitational direction through the classifying chamber, and that components are installed in the classifying chamber to permit controlling the residence time of the toner product, components which in the upper section of the classifying chamber quickly introduce the toner product in a homogeneous state into the classifying chamber, which in the central section of the classifying chamber permit a longer residence time of the toner product in comparison to the upper section of the classifying chamber, and which in the bottom section of the classifying chamber permit rapid discharge of the toner product from the classifying chamber.

The feed material exiting the comminution process is subjected to one or more classifying stages, dependent upon whether pure dedusting or a combination of dedusting and top-size limitation is required. If the demand is for pure dedusting, a coarse fraction which represents the end product is yielded as well as a fine fraction which can be reused. With combined dedusting and top-size limitation, a fine fraction, a coarse fraction, and a medium fraction—which represents the end product—are yielded. The other two fractions are either returned to the extrusion process or the comminution process. All-important to ensure a high precision of cut and to prevent product contamination is uniform distribution of the feed material, a controlled material feed during the classifying process, regulation of the residence time, and rapid discharge of the coarse material.

To increase the amount of product being classified, a multiple-stage classification is carried out. The coarse material from the previous classifying stage is charged to another classifier for final classification. The fines from each classifying stage can be collected in a common filter. The advantage of this method is that the loading factor can be far in excess of the otherwise standard range of between 0.05 and 0.3 kg/m$^3$. An estimate of the total loading factor ($\mu_{tot}$) is calculated using the following formula:

$$\mu_{tot}=\mu_1\times n^a$$

with $$1<a<1.6$$

The preferred value for "a" is 1.3. In the case of a three-stage classification (i.e., n=3), this then results in a possible loading factor ($\mu_{tot}$) of between 0.2 and 0.83 kg/m$^3$. Multistage classification is naturally also possible with the value of "a" lower than 1. This serves to optimise the product quality at maximum coarse yield.

The invention design comprises a vertical-axis air classifier equipped with a central feed section with a tangential classifying air inlet located on a level with the classifying wheel, a stationary guide vane ring surrounding the classifying wheel at a radial distance, an annular classifying chamber bounded by a deflector wheel classifying wheel supported on one side and a guide vane ring located coaxially at a radial distance to the outside periphery of the classifying wheel, a drive shaft for the classifying wheel supported on one side and a housing with fine material and coarse material discharge.

The material to be classified is charged centrally to the classifier, is then distributed over a large surface area by a centrifugal plate and routed as a uniformly distributed, bell-shaped cloud of product over the periphery of the classifying wheel past the classifying wheel vanes. The classifying air flows through the classifying wheel in a centripetal direction; the fines are routed to the inside of the classifying wheel. Gravity causes the rejected coarse material to move downwards, where it deposits in an annular-shaped coarse material discharge chamber.

The air flow pattern through the classifying chamber is centripetal. The rotating deflector wheel deflects the coarse material radially to the periphery and conveys the fines together with the classifying air to the inside of the classifying wheel. The classified fines are then deflected axially downwards and are discharged from the classifying wheel through the interrupted drive shaft to the outside.

This vertical-axis air classifier has the following components all located on the same side beneath the classifying wheel: the interrupted drive shaft, the annular fines discharge chamber located coaxially to the drive shaft, the annular coarse material discharge chamber also located coaxially to the drive shaft, and the classifier bearing.

DETAILED DESCRIPTION OF THE INVENTION

Figure 1:
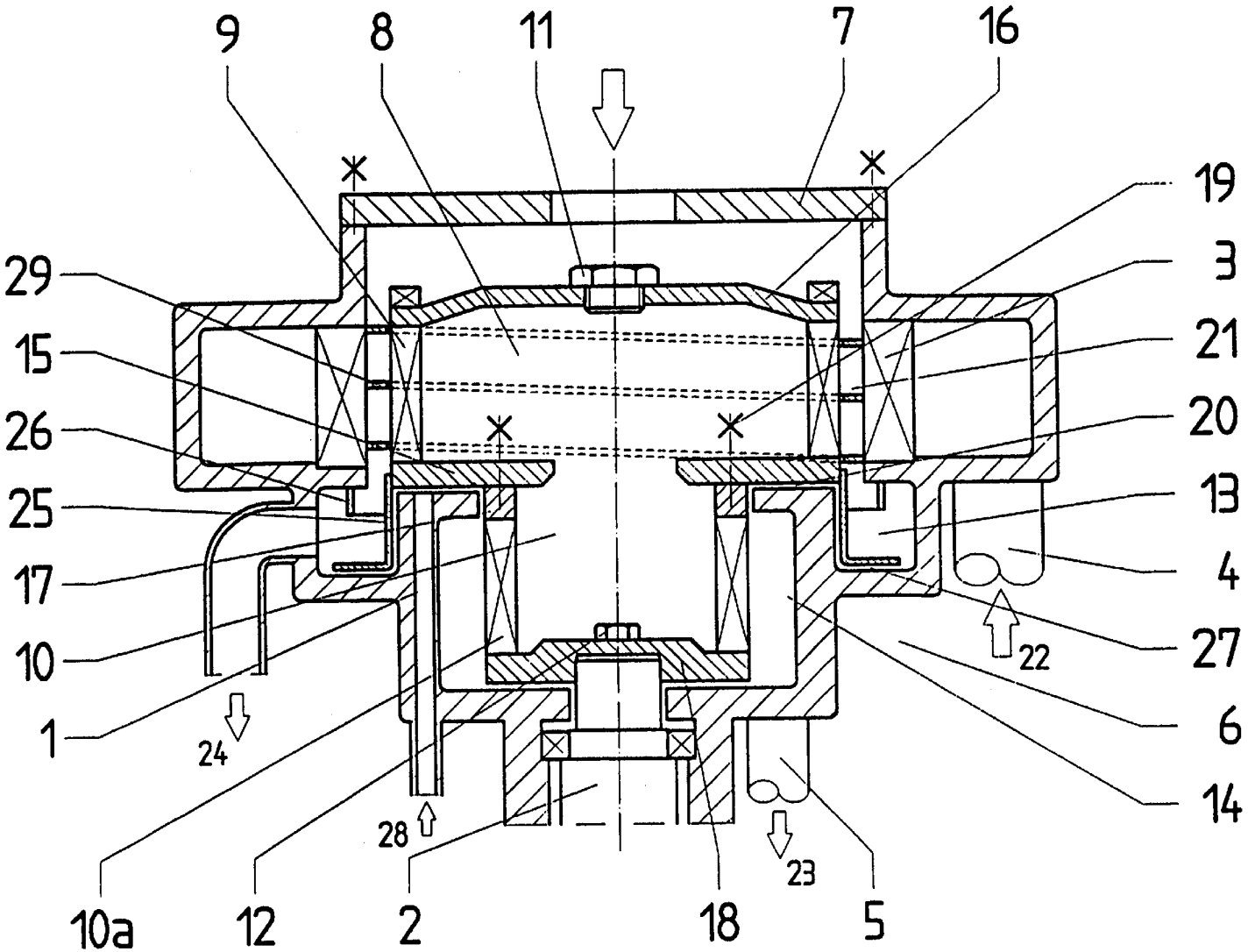
FIG. 1 shows a sectional elevation of the vertical-axis air classifier described here.

With the air classifier 6 as shown in FIG. 1, the drive shaft 2 is interrupted at the point where it penetrates the fines discharge chamber 14 and is replaced there by the support 10; this permits the fines to discharge from the inside of the classifying wheel 8 to the fines discharge chamber 14.

The support 10 comprises the bottom disc 18, the annular disc 17, and the streamlined spacer ribs 10*a*, which together form a connecting element via bolt 12 between the drive shaft 2 and the classifying wheel 8 and the apertures for discharge of the fines from the inside of the classifying wheel 8.

The classifying wheel 8 comprises the classifying wheel vane ring 9, the centrifugal top cover plate 16 with bolt 11 and the bottom cover plate 15, and is connected firmly to the support 10. This connection can be in a severable design in the area of the plates 15 and 17 and can, for example, be effected by screws 19 inserted uniformly around the periphery of the classifying wheel.

In the area of the plates 15,17 and the housing 1 fluid-rinsable seal 20 shown in axial arrangement which reliably separates the classifying chamber 21 from the fines discharge chamber 14.

In the axial transition area between the classifying wheel 8 and the support 10, the bottom cover plate 15 projects over the inside periphery of the annular plate 17 and thus over the support 10 into the inner zone, thus forming an orifice plate with a throttle effect in the transition area.

The product is fed to the top cover plate 16 of the classifying wheel 8, which forms a centrifugal plate. The annular channel which runs between the outside of the classifying wheel 8 and the inside of the guide vane ring 3 forms the classifying chamber 21 over the entire height of the classifying wheel 8.

The feed material enters through an opening in the housing top 7 and flows through the classifying chamber 21 vertically. To permit control of both the classifying material concentration in the classifying chamber 21 and the residence time, a helix 29 extends over almost the entire radial width of the classifying chamber 21 and over the entire height of the classifying wheel 8. In the design shown in the figure, a single helix with constant pitch is employed.

The flow direction of the classifying air is perpendicular to the stream of feed material. From the classifying air inlet 22, the classifying air flows horizontally through the classifying air inlet duct 4 and the stationary guide vane ring 3 into the classifying chamber 21 and flows through the chamber at right angles to the flow of feed material.

The classified fines are discharged axially through the fines discharge duct 5 and the fines discharge 23 along with the classifying air. The classified coarse material is discharged through the coarse material discharge chamber 13 under the classifying chamber 21 and exits through coarse material discharge 24.

The coarse material discharge ring 25 is fixed securely to the classifying wheel 8 and rotates within the coarse material discharge chamber 13. The stationary retaining ring 26 is located above the coarse material discharge chamber 13 and is fixed securely to the housing 1.

The aperture 27 for supplying the rinsing air 28 is located between the floor of the coarse material discharge chamber 13 and the coarse material discharge ring 25.

Figure 2:
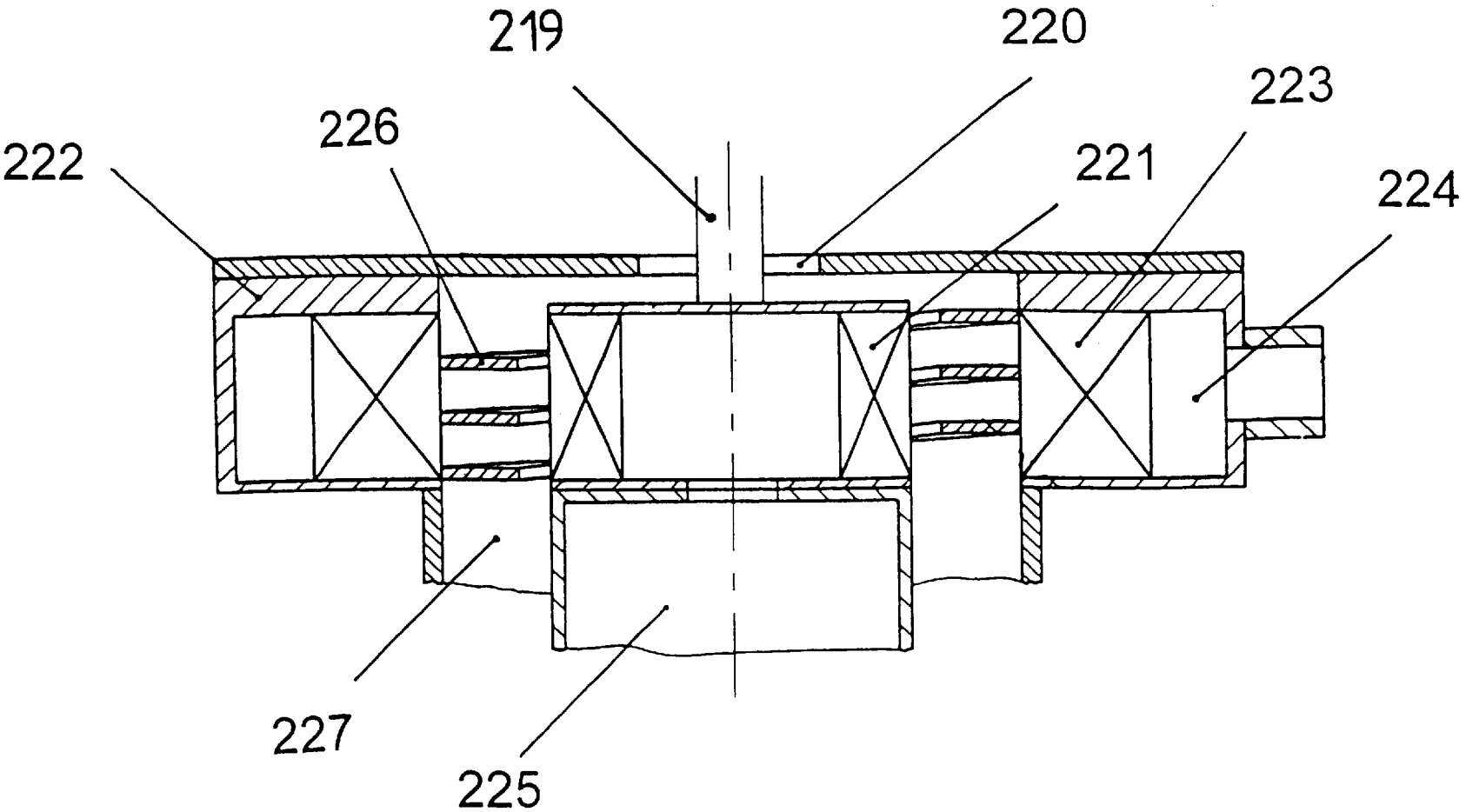
FIG. 2 shows a schematic representation of a design variant of the vertical-axis air classifier.

In FIG. 2, the drive shaft 219 is installed above the classifying wheel 221 and projects into the product feed area. The material is charged centrally from above through the annular feed opening 220 onto the classifying wheel 221. The material is catapulted outwards against the impact ring 222 and is thus distributed uniformly around the periphery. It then falls into the classifying gap between the vane ring 223 and the classifying wheel 221, where it is rinsed by the classifying air. The classifying air enters the classifying chamber through the spiral housing 224, flows through the classifying wheel 221 and exits the classifier together with the fines as a result of the gravitational force through the fines discharge 225 at the bottom while the coarse material enters the coarse material discharge chamber 227. The vane ring 223 is equipped with one or more helixes 226 to permit control of the residence time of the material. Dependent on the application, e.g. coarse or fine classification, different vane rings can be used.

Figure 2A:
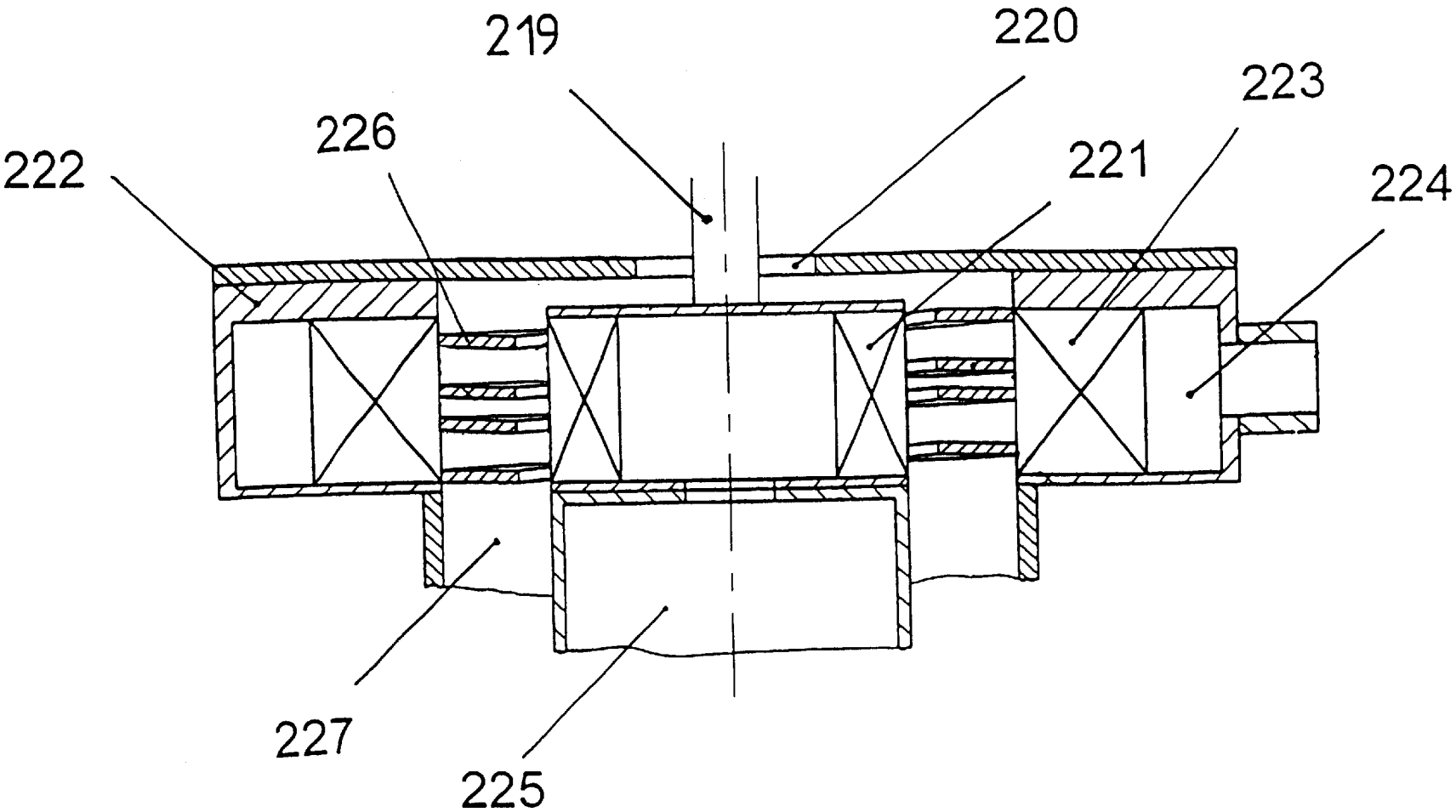
FIG. 2A shows an alternative embodiment of a vertical-axis air classifier with a helix that has a pitch that varies along its length.

FIG. 2A shows an embodiment of the helix 226 that varies along its length.

Figure 3:
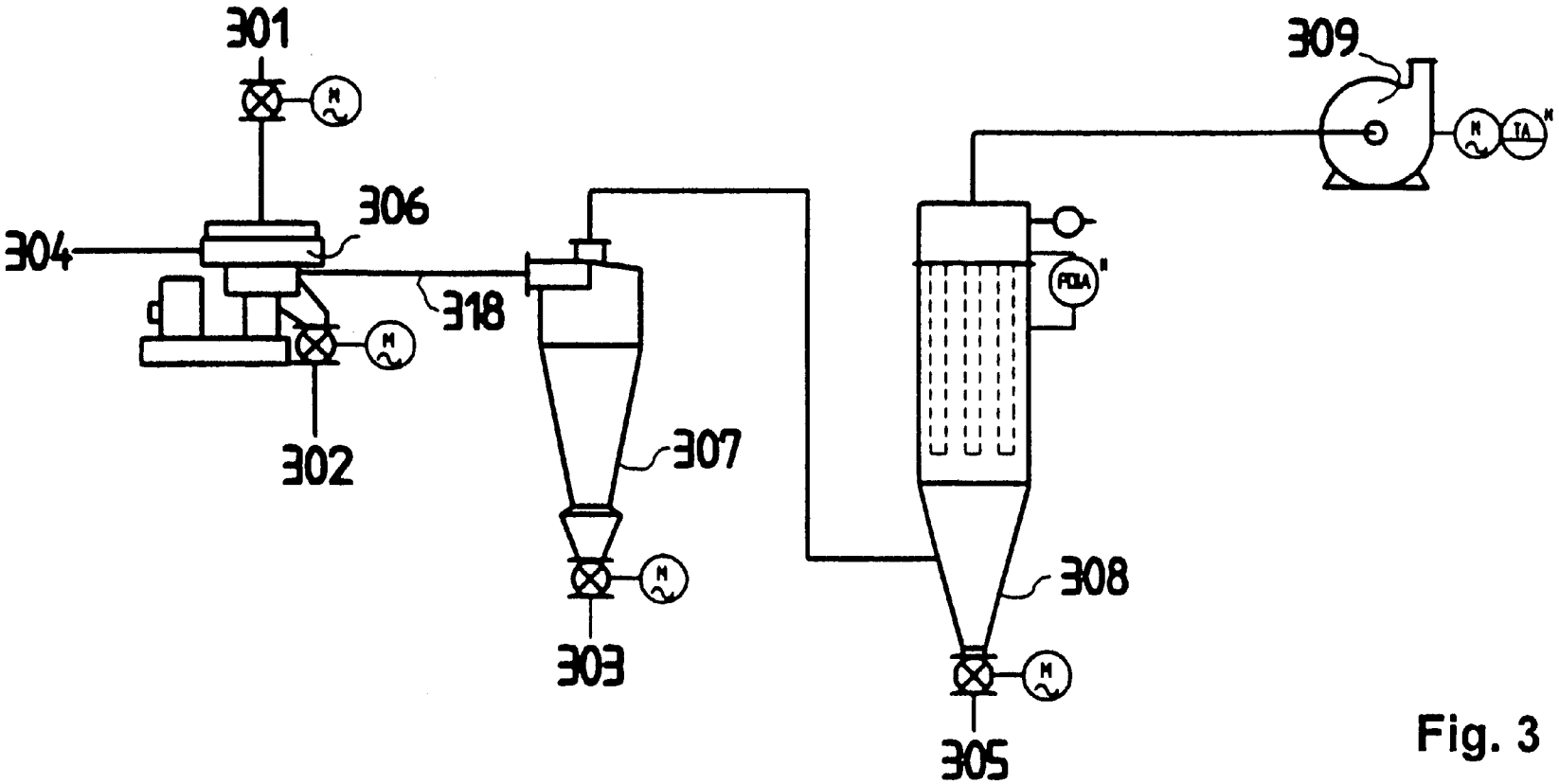
FIG. 3 shows a classifying process for dedusting.

FIG. 3 shows an invention-design classifying process for dedusting which features the above-described type of classifier. The feed material is charged from above by means of a suitable metering element 301. The ratio of the classifying air Volume flow rate to the feed mass flow rate should range between 0.05 kg/m$^3$ and 0.3 kg/m$^3$, and should preferably be 0.1 kg/m$^3$. The classifying air enters the classifier 306 via the classifying air inlet 304 and is suction-transferred through the classifier 306 into an optional cyclone 307 and a filter 308 by means of a fan 309. The fan 309 is adjusted so that the air flow rate at the outer edge of the classifying wheel ranges between 3 and 7 m/s.

In the case of fine classification, the peripheral speeds of the classifying wheel range between 40 and 65 m/s, whereas with coarse classifications, the preferred range is 20 to 45 m/s. The process described here can be operated with either a downstream cyclone 307 and a filter 308, or just with a filter 308. The classified fines are first of all routed to the cyclone 307 via the fines ducting 318, where the main portion is separated from the classifying air and discharged via the fines discharge 303. Ultrafine particles still entrained in the classifying air deposit in the filter 308 and can be removed via the dust discharge 305 once the filtrate has been detached from the walls of the filter element. The end product is yielded at the coarse material discharge 302.

Figure 4:
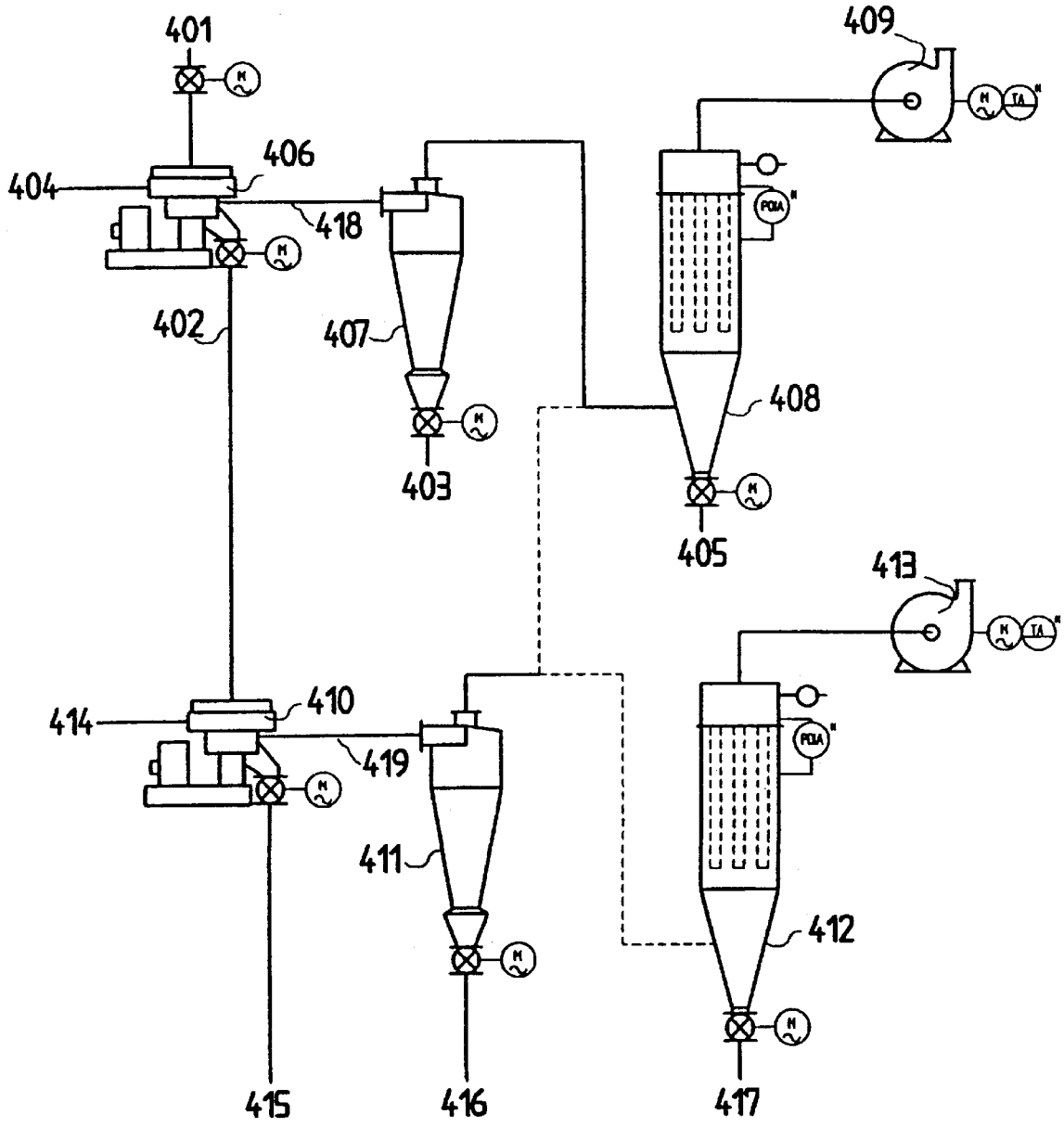
FIG. 4 shows a schematic representation of a classifying process for combined coarse and fine classification.

The process described in FIG. 3, therefore, is a simple method of fine classification for dedusting purposes, whereby as an option, a combined coarse classification and fine classification permitting simultaneous dedusting and top-size limitation can be carried out as detailed in FIG. 4.

FIG. 4 shows such a system configuration for a combined coarse and fine classification and a two-stage classification process.

With the combined coarse and fine classifying process, the material is first of all subjected to a fine classification as per FIG. 3. Thus, the first classifying stage includes metering element 401, first classifying air inlet 404, first classifier 406, first coarse material discharge duct 402, first fines duct 418, first cyclone 407, first fines discharge 403, first filter 408, first dust discharge 405 and first fan 409. Similarly, the second classifying stage includes second classifying air inlet 414, second classifier 410, second coarse material discharge duct 415, second fines duct 419, second cyclone 411, second fines discharge 416, second filter 412, second dust discharge 417 and second fan 413. The feed product for the second classifying stage is the coarse material from the first classifying process and is charged to the feed section of the second classifier 410 via the coarse material discharge ducting 402 of the first classifier. The product is then subjected to a coarse classifying process in order to limit the top size, i.e. the fines exiting the second classifying process through the cyclone 411 and the filter 412 are yielded at the fines discharge 416 and the dust discharge 417, respectively, and represent the actual end product. The extremely coarse portions, whose particle sizes are above the desired top-size limit, are discharged via the coarse material discharge 415 and can be rejected or returned to the grinding process.

The combination of fine and coarse classification in one system configuration means that there is no need for intermediate discharge of the product, because it can be charged direct from the coarse material discharge 402 to the second classifier 410. It is also possible to start off with the coarse classifying process and after discharging the material, to charge it to the second classifier for fine classification.

The system configuration shown in the FIG. 4 can be used in the same way for a two-stage fine classification. In this case, however, it is not the medium fraction from the fines discharge 416 and the dust discharge 417 which is yielded as the end product, but rather the coarse material from the coarse material discharge 415. Provided that the classifier settings are selected appropriately, an extreme dedusting of the product can be achieved. By adding more stages in an analogous manner, this configuration can be extended to form a multi-stage fine classification system.

Figure 5:
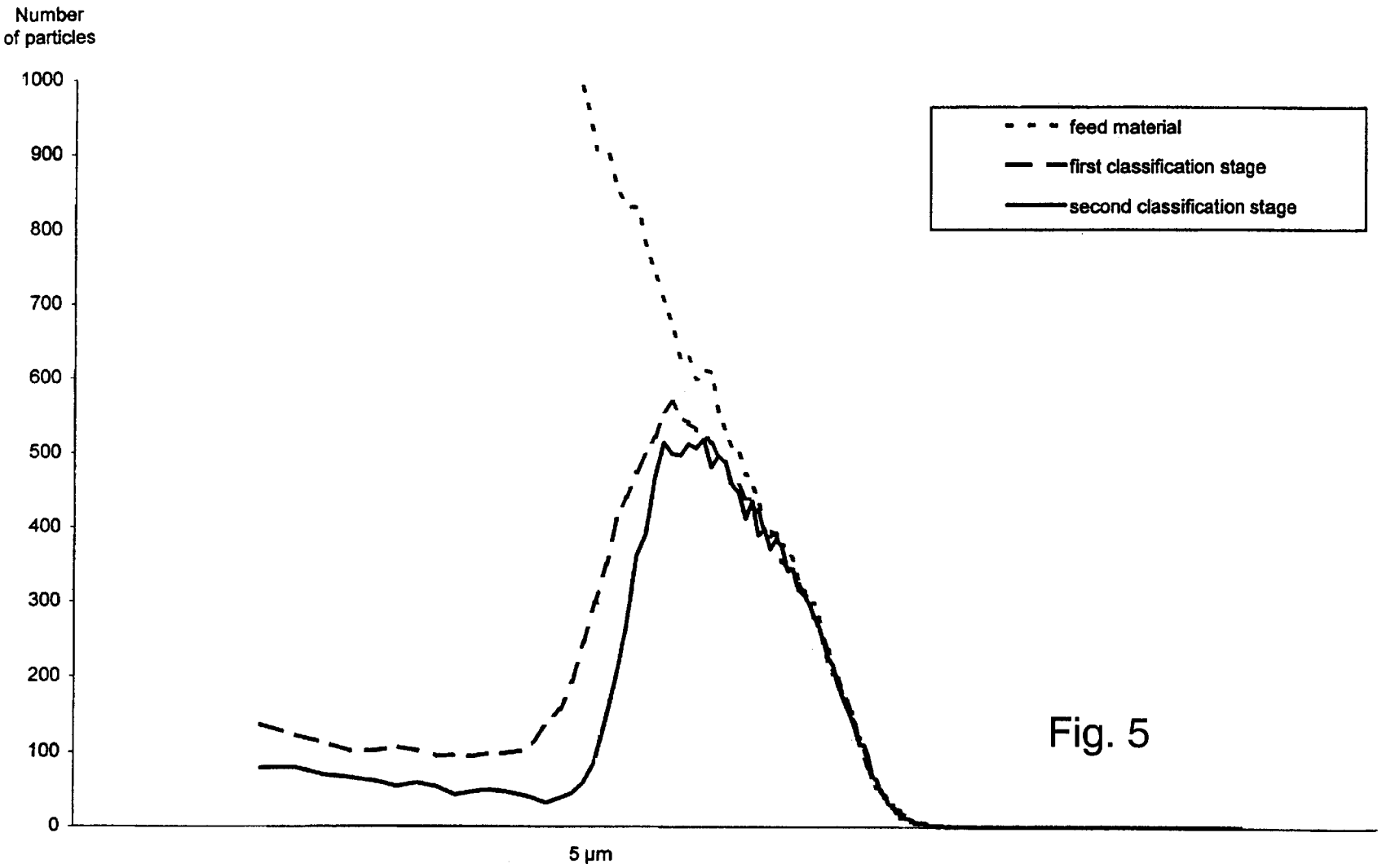
FIG. 5 shows graphic results of using the two-stage classifier of FIG. 4.
Figure 6:
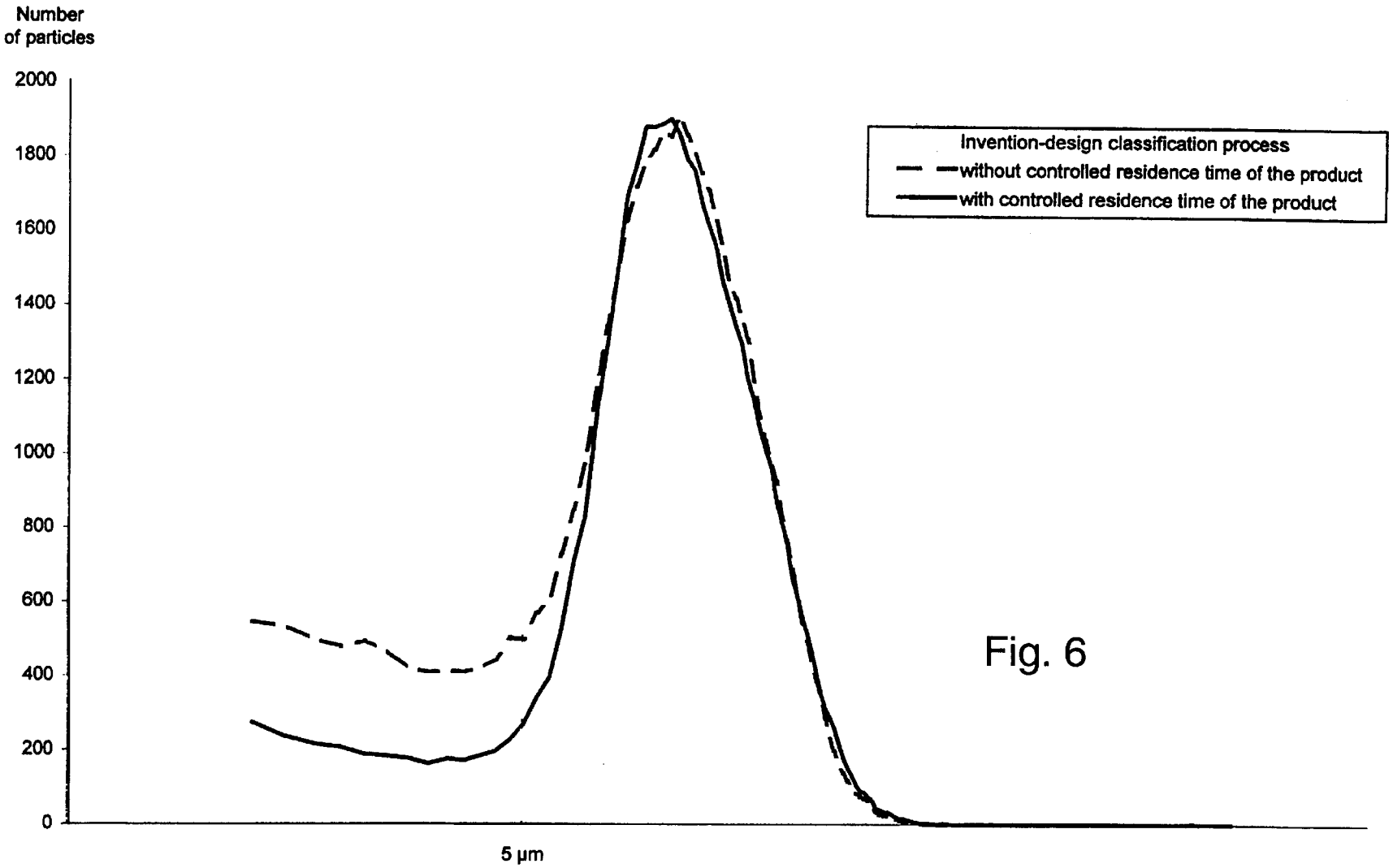
FIG. 6 shows graphic effects of controlling the residence time of the product.

FIGS. 5 and 6 represent particle size distributions measured with a Coulter Counter Multisizer from Coulter Electronics, Inc. (USA). Dedusting, where as much of the fine portion under 5 $\mu$m as possible was removed, was the objective here.

The feed material displays an extremely high portion of fines and because of this, represents inferior-quality toner. FIG. 5 shows how the product is improved by applying an invention-design, two-stage fine classification as per FIG. 4. Conspicuous is that the bulk of the ultrafine dust below 5 $\mu$m is separated as early as the first classification stage. The second stage succeeds in reducing the portion of ultrafine dust by about another 50%. The end product displays an extremely high gradient just above the cut point of 5 $\mu$m. Proof positive that the invention-design process accomplishes a separation with an extremely sharp precision of cut.

FIG. 6 shows two particle size distribution curves, one achieved with an invention-design classification process with controlled residence time of the product, the other achieved in a classification process without such a controlled residence time, whereby the classifier types and settings were identical in each case. At otherwise identical classifying conditions, controlling the residence time of the product in the classifying chamber makes it possible to separate considerably more ultrafine dust from the product.

What is claimed is:

1. A method for air classification of toner used to develop electrostatic images, whereby a toner product consisting of a powder with a wide particle size distribution is converted into a higher-quality toner product with a narrow particle size distribution, the improvement comprising:

distributing the toner product uniformly across the extent of a classifying wheel by means of a centrifugal plate; and routing the toner product by means of a controlled material feed section in a gravitational direction through a classifying chamber; and controlling the residence time of the toner product by components in the classifying chamber, wherein said components in the upper section of the classifying chamber quickly introduce the toner product in a homogeneous state into the classifying chamber, in the central section of the classifying chamber permit a longer residence time of the toner product than in the upper section, and in the bottom section of the classifying chamber permit rapid discharge of the toner product;

routing the classifying air with an average flow rate of between 3 and 7 m/s past an outer edge of the classifying wheel; and keeping a ratio of the toner product mass flow rate to the classifying air volume flow rate between 0.05 kg/m$^3$ and 0.3 kg/m$^3$.

2. The method of claim 1, wherein the component selected to control the residence time is a screw-shaped helix which spirals coaxially around the classifying wheel within the classifying chamber.

3. The method of claim 2, wherein the helix is only located in a partial area of a radial extent of a classifying chamber.

4. The method of claim 2, wherein a pitch of the helix varies along its length.

5. The method of claim 2, wherein controlling the residence time comprises passing the toner product along a helix that spirals around the classifying wheel within the classifying chamber.

6. The method of claim 1, wherein the ratio of toner product mass flow rate to classifying air volume flow rate is about 0.1 kg/m$^3$.

7. The method of claim 1, wherein the average flow rate of the classifying air is about 5 m/s.

8. A method for classifying particles comprising:

feeding coarse and fine materials into a classifying chamber;

transporting the materials cyclonically through the classifying chamber;

varying the axial velocity of the transported materials to control the residence time of the materials therein;

separating the coarse materials from the fine materials in the classifying chamber; and discharging the separated coarse and fine materials.

9. The method of claim 8, wherein the varying of the axial velocity of the materials comprises varying the axial velocity of the materials from a first axial velocity at a first axial location in the classifying chamber to a second axial velocity different from the first axial velocity at another axial location in the classifier.

10. The method of claim 9, wherein the varying of the axial velocity of the materials comprises varying the axial velocity of the materials from the first axial velocity at the first axial location in the classifying chamber to a third axial velocity at a third axial location in the classifying chamber.

11. The method of claim 9, wherein the first axial velocity is greater than the second axial velocity, and the materials are transported at the first axial velocity prior to the second axial velocity.

12. The method of claim 10, wherein the third axial velocity is greater than the second axial velocity, and the materials are transported at the second axial velocity prior to the third axial velocity.

13. The method of claim 8, further comprising separating the fine materials into fine particles and ultrafine particles.

14. The method of claim 8, further separating at least one of the discharged fine and coarse materials in another classifier of another classification stage.

15. The method of claim 8, wherein the axial velocity of the materials is varied by transporting the materials along a helix of a pitch that varies along the length of the helix.

16. The method of claim 15, wherein the helix is substantially continuous over a plurality of revolutions about the length of the classifying chamber.

17. The method of claim 8, wherein the axial velocity of the materials is varied according to the axial location of the materials so that the residence time of the materials is relatively shorter in the upper and lower sections of the classifying chamber relative to the middle section of the classifying chamber.

18. The method of claim 8, wherein transporting the materials through the classification chamber comprises transporting the materials into the classification chamber in a classifying medium comprising air and maintaining a ratio of the average air flow rate and feed material mass flow rate between about 0.05 $kg/m^3$ and 0.3 $kg/m^3$.

19. The method of claim 8, wherein the fine and coarse materials comprise toner.

20. A classifier for separating fine and coarse materials, comprising:

a classifying chamber;

a feed section operatively connected with the classifying chamber for feeding the fine and coarse materials thereto;

a classifying chamber configured to transport the fine and coarse materials in a cyclone for separating the fine and coarse materials;

a helix having a helical axis disposed within the classifying chamber and configured and dimensioned to control the flow of material through the classifying chamber, wherein the helix has a pitch that is varied along the helical axis; and a coarse and fine material discharge chambers operatively connected to the classifying chamber for discharging the coarse and fine materials, respectively.

21. The classifier of claim 20, wherein the helix is substantially continuous over a plurality of revolutions about the classifying chamber.

22. The classifier of claim 20, wherein the classifying chamber comprises a classifying wheel that is rotationally driven within the classifying chamber for separating the coarse and fine materials.

23. The classifier of claim 22, wherein the peripheral speed of the classifying wheel ranges between 40 m/s and 65 m/s.

24. The classifier of claim 20 further comprising:

an air mover configured for moving air through the classifying chamber; and the air mover and classifying chamber are configured to maintain the ratio of air volume flow rate and toner mass flow rate through the classifying chamber between about 0.05 $kg/m^3$ and 0.3 $kg/m^3$.

25. The classifier of claim 20, wherein:

the classifying chamber is configured for transporting the fine and coarse materials in a classifying medium comprising air; and the air flow rate at the outer edge of the classifying wheel is between about 3 and 7 m/s.

* * * * *

UNITED STATES PATENT AND TRADEMARK OFFICE

CERTIFICATE OF CORRECTION

PATENT NO. : 6,260,708 B1
DATED : July 17, 2001
INVENTOR(S) : Adam et al.

It is certified that error appears in the above-identified patent and that said Letters Patent is hereby corrected as shown below:

Title page,
Item [75], Inventors: change the spelling of the third-named inventor from "Bodo Furc Hner" to -- Bodo Furchner --.

Signed and Sealed this

Twenty-ninth Day of January, 2002

*Attest:*

*Attesting Officer*

JAMES E. ROGAN
*Director of the United States Patent and Trademark Office*